US005199711A

United States Patent [19]

Pataki et al.

[11] Patent Number: 5,199,711

[45] Date of Patent: Apr. 6, 1993

[54] THREE-DIMENSIONAL LOGICAL TOY

[76] Inventors: Zoltan Pataki, MSZMP Udulo, H-8171 Balatonaliga; Geza Csomos, Heimhuder Strasse 46, D-2000 Hamburg 13; Janos Feher, Szentkiratyi u. 46, H-1088 Budapest, all of Hungary

[21] Appl. No.: 646,751

[22] PCT Filed: May 17, 1990

[86] PCT No.: PCT/HU90/00034

§ 371 Date: Mar. 18, 1991

§ 102(e) Date: Mar. 18, 1991

[87] PCT Pub. No.: WO90/14140

PCT Pub. Date: Nov. 29, 1990

[30] Foreign Application Priority Data

May 17, 1989 [HU] Hungary ..... 2441/89

[51] Int. Cl.[5] ..... A63F 9/08

[52] U.S. Cl. ..... 273/153 S

[58] Field of Search ..... 273/153 S, 153 R

[56] References Cited

U.S. PATENT DOCUMENTS

| | | | |
|---|---|---|---|
| 4,496,155 | 1/1985 | Goldfarb | 273/153 S |
| 4,500,090 | 2/1985 | Nieto | 273/153 S |
| 4,586,713 | 5/1986 | Abu-Shumays et al. | 273/153 S |
| 4,593,908 | 6/1986 | Ibrahim | 273/153 S |
| 4,836,549 | 6/1989 | Elake | 273/153 S |

FOREIGN PATENT DOCUMENTS

| | | | |
|---|---|---|---|
| 2527087 | 11/1983 | France | 273/153 S |

OTHER PUBLICATIONS

Buckingham Toys, "Alexander's Star", 1982.

*Primary Examiner*—V. Millin
*Assistant Examiner*—Steven Wong
*Attorney, Agent, or Firm*—Antonelli, Terry, Stout & Kraus

[57] ABSTRACT

A three-dimensional logical toy having regular, irregular or amorphous composite members of various shapes as symbol-bearing components and forming a unit, whereby the shaped members making up the composite body may be allocated to three main groups within which the configurations are identical, and whereby the shaped bodies may be rearranged by rotation along the axis traversing the geometrical central point of the composite body. The composite enclosing body (1) is made up of 18 shaped members (2, 3, 4) falling into three different groups and arranged in three mutually parallel layers, which are delimited by two surfaces, viz. one having the configuration of a regular hexagram and one parallel thereto having the configuration of a regular hexagonal. The body is shaped as a composite, form-locked enclosing body along the surface of hexagram configuration.

4 Claims, 4 Drawing Sheets

THREE-DIMENSIONAL LOGICAL TOY

BACKGROUND OF THE INVENTION

The present invention relates to a three-dimensional logical toy comprising a body made up of symbol-bearing components forming a unit and comprised of regular or irregular or amorphous composite bodies, in which the receiving members may be allocated to three groups; within the groups the shaped members are indentical in their constructional configuration; in addition, the shaped members can be set in motion by rotation about the axes which traverse the geometrical center.

Numerous versions of three-dimensional logical toys are known which have as their objective the rearrangement of the components which make up the toy along predetermined axes of the coordinates by means of rotation. The best-known toy is described in Hungarian patent specification HU-PS 170 062. This toy has a cubical enclosing body within the interior of which a smaller cube is disposed, in which, in the direction of the axes traversing the cube, one resilient stud for each direction is provided. The cube is made up of 27 three-dimensional shaped bodies, while the external configuration corresponds to that of the enclosing body. The components may be rearranged by means of rotation.

A similar three-dimensional logical toy is described in Hungarian patent specification HU-PS 180 385. An octahedron constitutes the enclosing body of the three-dimensional toy described in that patent specification the components may be allocated to three groups and, within the individual groups, is made up of uniform components. The components are rotated around about the four axes of coordinates and thus are rearranged.

The disadvantage to which the aforementioned three-dimensional toys are subject is that, during the rotational movement, it is possible, essentially by means of the change in the edge position, to likewise alter the position of the components which make up the enclosing body. Furthermore, these are constructed in such a way that it is possible to achieve the function solely with the aid of one internal core component.

It is the object of the present invention to develop a three-dimensional logical toy which avoids the disadvantageous features of the toys known up to now and in which the position of the component making up the toy can be altered during playing. In addition thereto the toy is constructed in such a way that the internal complicated core component can be dispensed with.

The objective attained by the invention is achieved with the aid of a three-dimensional logical toy whose enclosing body is made up of eighteen shaped bodies which are allocated to three different groups and disposed in three layers extending in mutually parallel arrangement, which are delimited by two surfaces possessing the configuration of a regular hexagon, and the shaped members along the surface of the regular hexagram configuration are constructed so as to form a composite shaped member.

SUMMARY OF THE INVENTION

In an advantageous embodiment of the three-dimensional logical toy according to the invention, the intermediate layer of the enclosing body is formed by shaped members that can be allocated to two groups which are provided with self-locking projections that are formed on the lateral surfaces and adjoin each other, while the upper and lower surfaces, which are immediately adjacent the intermediate layer and which constitute the top and bottom layer of the enclosing body, are provided with projections that receive the grooves of the shaped members adjoining them.

In a further advantageous embodiment of the three-dimensional logical toy according to the invention, the shaped members forming the intermediate layer of the accommodating body are delimited by a swallowtail-like configured surface and a surface parallel thereto possessing the shape of an equilateral triangle and are comprised of members which are composed along the surface which is configured in the manner of a swallowtail.

In a further advantageous embodiment of the three-dimensional logical toy according to the invention, the shaped members constituting the bottom or the top layer are formed with the aid of such members which are made up of a prism with a base having the configuration of an equilateral triangle and a member portion, said member portion being linked up to the one surface of the prism and constructed in the form of an isosceles triangle. In addition, a projection is provided which fits into the grooves of the projection of the shaped member which constitutes the intermediate layer of the enclosing body.

In a further expedient embodiment of the three-dimensional logical toy according to the invention, the shaped members forming the enclosing body are provided with L-shaped projections and with L-shaped grooves and slot-like recesses for receiving these projections.

In all the advantageous embodiments of the three-dimensional logical toy according to the invention, the outer surface of the shaped member constituting the enclosing body is provided with one or several distinguishing symbols. If necessary, the shaped member forming the bottom and top layer may be provided with symbols which diverge from one another.

In the three-dimensional logical toy according to the invention, the distinguishing symbols applied to the lateral surfaces of the shaped members may be differentiated by means of colors or digits and/or characters and/or other means of identification.

BRIEF DESCRIPTION OF THE DRAWINGS

An embodiment of the three-dimensional logical toy according to the invention, which is intended to serve as an example, is explained below in greater detail with the aid of the appended drawings. Thus.

DETAILED DESCRIPTION OF THE PREFERRED EMBODIMENT

Figure 1:
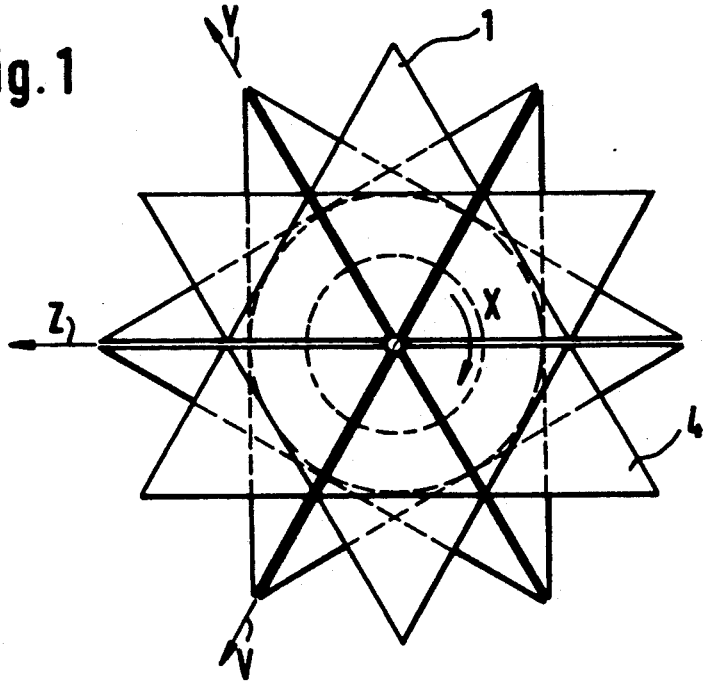
FIG. 1 shows the top view of the three-dimensional logical toy according to the invention while at the same time depicting the rotational position.

The FIG. 1 depicts the top view of the three-dimensional logical toy according to the invention. Essentially the three-dimensional logical toy according to the invention is a toy with components which may be allocated to three different groups, in which case, each group possesses one enclosing body 1 which, in turn, is made up of uniformly configured shaped members 2, 3, 4 (see FIGS. 3, 6, and 9). The shaped members 2, 3, 4 making up the enclosing body 1 are disposed in three layers so as to extend parallel to each other.

In respect to the construction, the enclosing body is delimited by a surface area possessing the configuration of a regular hexagram and a surface area parallel thereto having a base shaped like a regular hexagram and is disposed in the form of a member assembled along the surface area possessing the shape of a regular hexagram.

On account of the described construction of the enclosing body 1, the top view of the three-dimensional logical toy according to the invention corresponds to a regular hexagram.

The rearrangement of the shaped members 2, 3, 4 making up the body 1 is effected by rotating the enclosing body 1 about the axis X which traverses the central point of the enclosing body 1 and extends out of the plane of FIG. 1, as well as about the axes which lie in the plane that is perpendicular axis. The rearrangement will be described at a later point in greater detail. We would like to mention first that, for the purpose of a better understanding, the initial position necessary for the rearrangement is depicted in the FIG. 1.

Figure 2:
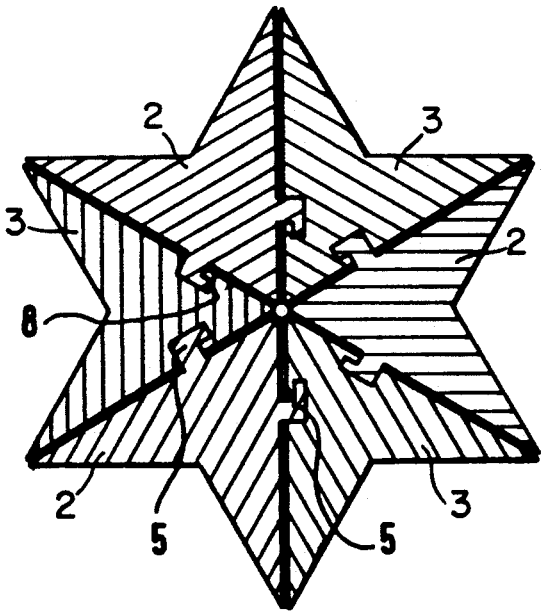
FIG. 2 shows the section of the three-dimensional logical toy according to FIG. 1.

The FIG. 2 represents the section of the three-dimensional logical toy according to FIG. 1. In FIG. 2 the section is taken according to the plane which is perpendicular to the axis X and also accommodates the central point of the enclosing body. Thus, the section corresponds essentially to the section of the plane of symmetry of the shaped members 2,3 which form the intermediate portion of the enclosing body. The figure clearly depicts the disposition of the shaped members 2 and 3 as well as their interconnection. The shaped members are self-closing shaped members which are interconnected with the aid of the projections 5 formed on the lateral surfaces and the grooves which receive said projections. Expediently, the projections 5 and the grooves 8 possess an L-like configuration.

Figure 3:
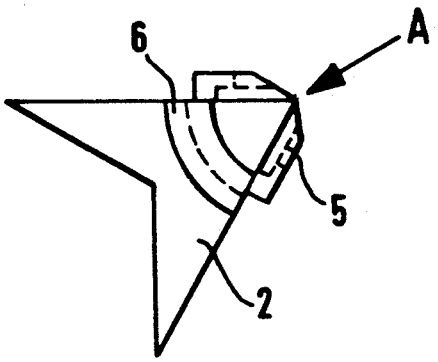
FIG. 3 shows the top view of one of the shaped members which constitutes the intermediate portion of the three-dimensional logical toy according to FIG. 1.

FIG. 3 shows the top view of the shaped member 2 which is included in the intermediate layer of the three-dimensional toy according to the invention. The lateral surfaces of the shaped member 2 are provided with projections 5 which fit into the grooves 8 on the lateral surface of the shaped member 3, as shown in FIG. 2.

Figure 4:
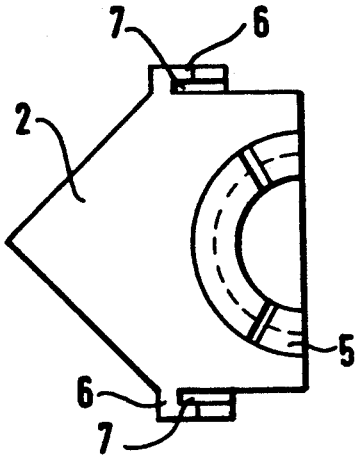
FIG. 4 shows the side view of the shaped member according to FIG. 3.

FIG. 4 depicts the side view of the shaped member according to FIG. 3. The shaped member 2 is delimited by a swallowtail-like configuration and thus parallel surface possessing the shape of an equilateral triangle and, along the swallowtail-like configured surface, forms a composite member, on whose surfaces having the form of an equilateral triangle, projections 6 provided with grooves 7 are constructed which accommodate the projections of the adjoining shaped member 4. The projections 5 and the grooves 7 formed on the shaped member 2 possess an L-shaped configuration, while the projections 5 provided on the lateral surfaces are arranged in a semicircle.

Figure 5:
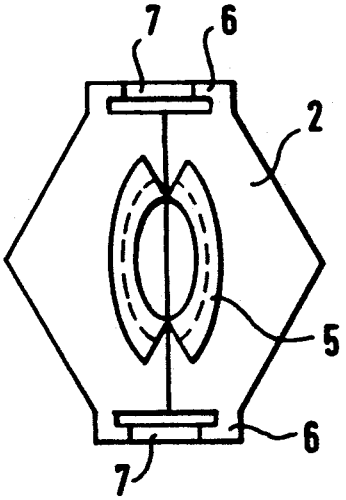
FIG. 5 shows a view of the shaped member according to FIG. 3 taken in the direction of "A"

In FIG. 5, the view of the shaped member 2 according to FIG. 3 is shown in the direction "A", the three-dimensional position of the projections 5 and 6 and of the grooves 7 is illustrated.

Figure 6:
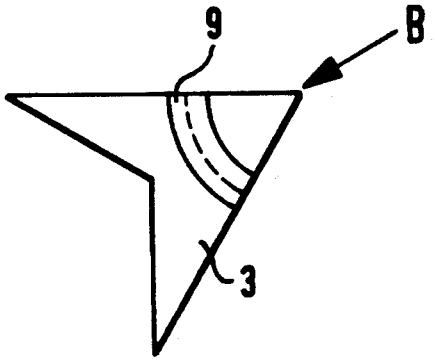
FIG. 6 shows the top view of another shaped member which constitutes the intermediate layer of the enclosing body of the three-dimensinal logical toy.
Figure 7:
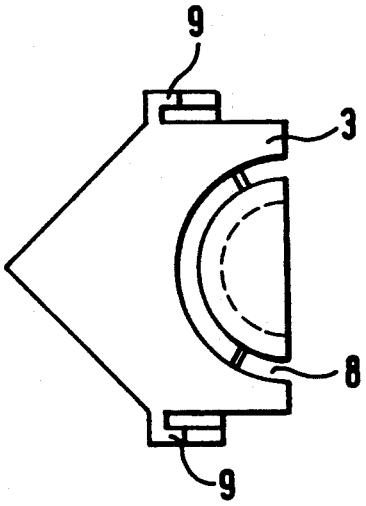
FIG. 7 shows the side view of the shaped member according to FIG. 6.
Figure 8:
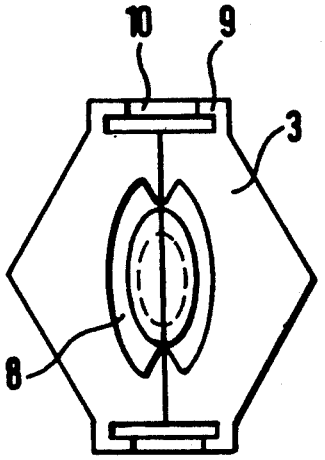
FIG. 8 shows the view of the shaped member according to FIG. 6 taken in the direction "B"

FIG. 6 shows the top view of the configuration of the further shaped member 3 which links the shaped members 2 to make up the intermediate layer of the enclosing body—which, incidentally, is known from the description of the FIG. 3. In essence, the constructional configuration of the shaped member 3 is identical with the one according to the FIGS. 3 thru 5. The sole difference consists in that, on the lateral surface, a groove 8 is constructed which receives the projection 5 of the shaped member 2. FIGS. 7 and 8 illustrate the construction and the disposition of the groove 8 in a clearly discernible manner.

The interconnection between the shaped members 2 and 3 has already been described in connection with the FIG. 2.

Figure 9:
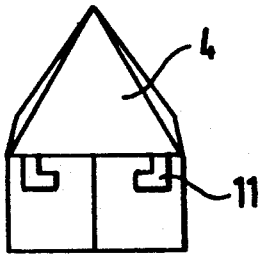
FIG. 9 shows the front view of the shaped member which constitutes the bottom and the top layer of the enclosing body of the three-dimensional toy according to the invention as per FIG. 1.

FIG. 9 depicts the front view of the shaped member 4, from which the final shape of the enclosing body 1 results and which adjoins the shaped members 2 and 3 that constitute the intermediate portion of the enclosing body 1. As has already been described in connection with FIGS. 3 and 5, the shaped members 4 constitute the bottom and top layers of the enclosing body 1. In addition, L-shaped projections 11 are provided to fit within the grooves 7 and 10 in the projections 6 and 9.

Figure 10:
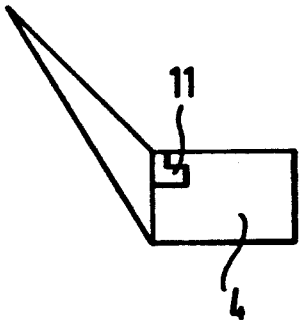
FIG. 10 shows the side view of the shaped member according to FIG. 9.
Figure 11:
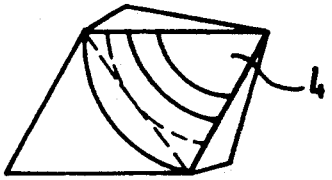
FIG. 11 shows the view of the base of the shaped member according to FIG. 9.
Figure 12:
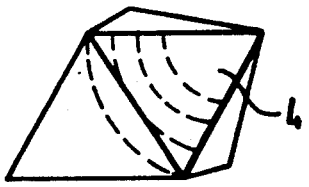
FIG. 12 shows the top view of the shaped member according to FIG. 9.

FIG. 10 shows the lateral view of the shaped member 4, while FIG. 11 depicts the underside and FIG. 12 represents the top view of the shaped member 4.

Figure 13:
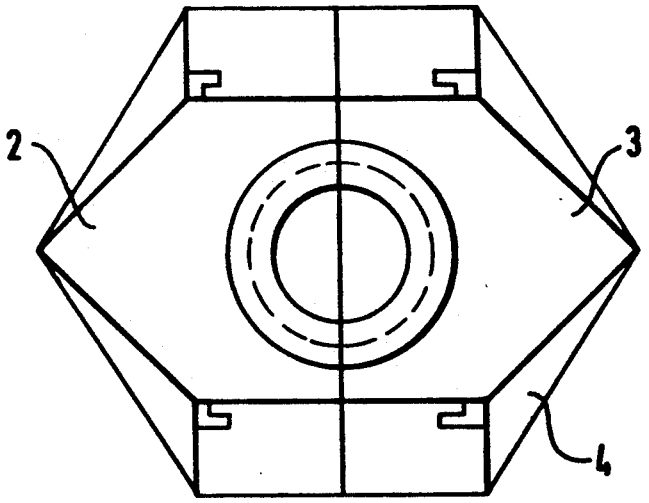
FIG. 13 shows the section drawn along the plane "Z" of the toy according to FIG. 1.

Substantially, the shaped member 4 is composed of a prism possessing a base having the configuration of an equilateral triangle and a member portion possessing the shape of an isosceles triangle which adjoins a surface of said prism. FIG. 13 illustrates the section drawn in the plane "Z" of the toy in the rotated position, from which appears the reciprocal connection between the shaped members 2,3 forming the intermediate layer and the shaped members 4 constituting the bottom and the top layers.

The mode of operation of the three-dimensional logical toy according to the invention is detailed in the following.

As a first step—so as to ensure the rotatability—the regular hexagram is rotated along the axis X (FIG. 1) through 30°. In this way the planes Y, Z, V, the sectional planes, come into being, while in these planes, along the axes which are perpendicualr to the axis X and which traverse the geometrical central point of the enclosing body 1, the shaped members 2,3,4 can be rotated, by means of said rotation the rearrangement is realized.

Essentially, the rearrangement holds numerous playing possibilities since it is possible to make it the objective of the rearrangement to rearrange the distinguishing symbols applied to the lateral surfaces of the shaped members 2 and 3 consituting the intermediate layer—by preference colors—this rearrangement being effected in accordance with a principle that is determined before hand. This means that the distinguishing symbols are transferred from an unarranged state into an arranged one or into the arranged state of these symbols. In this solution the symbols applied to the free lateral surfaces of the shaped members 4 may be disregarded.

In a further possibility of the game, the objective of the rearrangement consists in that the symbols applied to the shaped members 4 are arranged according to a certain principle. Thus the shaped members may e.g. bear 4 digits which are then grouped in accordance with a certain principle.

In the course of the game the possibility exists of combining the rearrangement modes described in the foregoing, viz. for instance, to arrange the symbols on the lateral surfaces of the shaped members 2 and 3 forming the intermediate layer, as well as the symbols on the shaped members 4 in accordance with a certain principle. The game is of course rendered more difficult in this case.

The advantage of the three-dimensional logical toy according to the invention consists in that the logical readiness and the visual conceptualization of children is developed, and in the process an enjoyable game is ensured while it is possible to combine various degrees of difficulties.

What is claimed is:

1. A three-dimensional logical toy comprising:

three first-shaped members, each first-shaped member including a first portion having a pair of substantially equilateral-triangle shaped surfaces and a second portion having a pair of substantially swallowtail-like shaped surfaces, one swallowtail-like shaped surface extending from each equilateral-triangle shaped surface, each first-shaped member further including a pair of planar surfaces abutting the equilateral-triangle shaped surfaces and the swallowtail-like shaped surfaces, each of the planar surfaces and the equilateral-triangle shaped surfaces having an arcuate locking projection extending therefrom;

three second-shaped members, each second-shaped member including a first portion having a pair of substantially equilateral-triangle shaped surfaces and a second portion having a pair of substantially swallowtail-like shaped surfaces, one swallowtail-like shaped surface extending from each equilateral-triangle shaped surface, each second-shaped member further including a pair of planar surfaces abutting the equilateral-triangle shaped surfaces and the swallowtail-like shaped surfaces, each of the planar surfaces having an arcuate locking groove extending thereinto, each of the equilateral-triangle shaped surfaces having an arcuate locking projection extending therefrom, the pair of planar surfaces of each second-shaped member abutting planar surfaces of a pair of first-shaped members with the arcuate projections on the planar surfaces of the first-shaped members within the arcuate locking grooves on the abutting planar surfaces of the abutting second-shaped members to interlock the first-shaped members and the second-shaped members into an intermediate layer of members while permitting the first-shaped members and second-shaped members to rotate relative to each other;

a first set of six third-shaped members, each third-shaped member shaped like a prism with a base portion shaped like an equilateral triangle and a second portion shaped like an isosceles triangle, with the base portion having a locking projection extending therefrom, the base portion of each member of the first set of third-shaped members abutting an equilateral-triangle shaped surface of one of the first-shaped members and the second shaped members with the locking projection of each member of the first set of third-shaped members cooperating with the locking projection on the abutting equilateral-triangle shaped surface of the abutting first-shaped and second-shaped members to interlock the first set of third shaped members with the first-shaped and second-shaped members into a top layer while permitting the first set of third-shaped members to rotate relative to the abutting first-shaped and second-shaped members; and a second set of six third-shaped members, the base portion of each member of the second set of third-shaped members abutting an equilateral-triangle shaped surface of one of the first-shaped members and the second shaped members with the locking projection of each member of the second set of third-shaped members cooperating with the locking projection on the abutting equilateral-triangle shaped surface of the abutting first-shaped member to interlock the second set of third-shaped members with the first-shaped and second-shaped members into a bottom layer while permitting the second set of third-shaped members to rotate relative to the abutting first-shaped and second-shaped members, to form the three-dimensional toy.

2. A three-dimensional logical toy according to claim 1 wherein the shaped members have external surfaces defining an enclosing body and each external surface is provided with at least one distinguishing symbol.

3. A three-dimensional logical toy according to claim 2 wherein the symbols of the members of the intermediate layer, the members of the top layer, and the members of the bottom layer are different from one another.

4. A three-dimensional logical toy according to claim 3, wherein the different symbols include different colors, digits, characters, and/or figures.

* * * * *